United States Patent [19]

Takamizawa et al.

[11] 4,204,030

[45] May 20, 1980

[54] ORGANOPOLYSILOXANE SIZED PAPERBOARDS FOR GYPSUM WALLBOARDS

[75] Inventors: Minoru Takamizawa; Akira Abe; Yoshiaki Ono; Yutaka Sugimori, all of Annaka; Tetsuo Kishibayashi, Urawa; Makoto Ino, Toride, all of Japan

[73] Assignees: Shin-Etsu Chemical Co. Ltd.; Yoshino Gypsum Co. Ltd., both of Tokyo, Japan

[21] Appl. No.: 837,191

[22] Filed: Sep. 28, 1977

[30] Foreign Application Priority Data

Oct. 5, 1976 [JP] Japan ..... 51-119566

[51] Int. Cl.[2] ..... B32B 9/04

[52] U.S. Cl. ..... 428/447; 428/314; 428/511; 428/449; 427/209; 427/211; 162/164 R; 525/478

[58] Field of Search ..... 428/447, 449, 511, 314; 260/825

[56] References Cited

U.S. PATENT DOCUMENTS

| | | | |
|---|---|---|---|
| 3,389,042 | 6/1968 | Bieri et al. | 428/342 X |
| 3,878,263 | 4/1975 | Martin | 260/825 |
| 4,070,526 | 1/1978 | Colquhoun et al. | 428/447 |

FOREIGN PATENT DOCUMENTS

| | | | |
|---|---|---|---|
| 1079249 | 9/1967 | United Kingdom | 428/314 |

*Primary Examiner*—P. C. Ives

*Attorney, Agent, or Firm*—Toren, McGeady and Stanger

[57] ABSTRACT

Novel and improved paperboards useful for making gypsum wallboards, which are sized with a specific organopolysiloxane comprising mercaptoalkyl containing organosiloxane units and, optionally, methacryloxy-containing organosiloxane units in its molecular structure. The sizing compound is used in a relatively small amount and yet can exhibit an excellent effect within a very short time. The sized paperboards have adequately controllable moisture absorption as well as air permeability. They are used to cover or sandwitch a gypsum core to form a complete wallboard in a convenient and economical manner.

10 Claims, No Drawings

ORGANOPOLYSILOXANE SIZED PAPERBOARDS FOR GYPSUM WALLBOARDS

BACKGROUND OF THE INVENTION

The present invention relates to sized paperboards. More particularly, the invention relates to novel and improved multi-ply paperboards useful in the manufacture of gypsum wallboards.

Gypsum wallboard is a well known structural precast unit useful as the wall or ceiling material of residential or industrial buildings and made of a gypsum core which has been set by hydration and two covering multi-ply paperboards which sandwich the core, the contacting surfaces being firmly bonded to each other.

Such gypsum wallboards are manufactured, according to the most widely practiced process, in the following steps or operations. An aqueous hydraulic slurry of calcined gypsum is poured into the space provided between two separate multi-ply paperboards while continuously and endlessly advancing at the same velocity. As the gypsum slurry becomes to set or hardened due to hydration to form a core sandwitched by the two covering paperboards, the whole board is passed through a high-temperature drying kiln, where most of excessive water content in the board is removed by evaporation. The thus treated board is cut into desired lengths.

The paperboard, specifically the core-side liner or ply of the multi-ply paperboard, can bond to the hardened gypsum core without the use of any adhesives in principle. This is because numerous needle-like cystals are formed in the gypsum slurry soaked in the paperboard and elongate into the texture of the paperboard, resulting in an intimately interlaced structure to produce a sufficient bonding strength between the gypsum core and the covering paperboard.

It is a conventional technique to add to the aqueous slurry of calcined gypsum small amounts of a water-soluble polymeric substance, such as starch. The addition of starch is intended, in part on one side, to produce an auxiliary adhesive bond between the gypsum core and the paperboards but, in major part on the other side, to provide coatings on the crystals of the hydrated gypsum so that any losses in bonding strength between the paperboards and the hydrated gypsum core can be prevented if and when the crystals of the hydrated gypsum ($CaSO_4.2H_2$) is dehydrated into the state of calcined gypsum ($CaSO_4.\frac{1}{2}H_2$) or further into the state of anhydrous gypsum ($CaSO_4$) during the drying step in the high temperature kiln operated at excessively high temperatures, say, above 80° C.

Important technical problems to be solved in the above-described conventional manufacturing process of gypsum wallboards include the following:

(1) The drying velocity in the drying kiln should be sufficiently high to ensure high productivity.

(2) The interlacing of the hydrated gypsum crystals and the paper texture should be well developed so as to give a sufficient bonding strength.

(3) The amount of an expensive water-soluble polymeric substance like starch to be added to the aqueous slurry of calcined gypsum should be reduced to as low as possible without causing troubles with respect to the problems (1) and (2) above.

(4) It should be realized that the starch added does not spread evenly throughout the inside and surface of the hydrated gypsum core or migrate into the entirety of the multiplied paperboards, but concentrate near the interface between the core of the hydrated gypsum and the covering paperboards.

The solution of the above problems is largely dependent on the quality of the paperboards used. For the purpose, the paperboards are required to have such qualities as high mechanical strengths, low moisture absorption, small changes in dimensions when wet, and fine appearance as well as adequate water absorptivity and high air permeability, the latter two qualities being particularly important. For example, if the air permeability of the paperboards is not sufficiently high, the dissipation of water vapors during the drying ste is hindered, and it is required disadvantageously to provide a longer drying kiln.

The water absorptivity and air permeability are, sometimes, contradictory requirements to each other for a paperboard suitable for the manufacture of gypsum wallboards. It is a very difficult problem to satisfy both requirements simultaneously. For example, conventional sizing materials, such as rosin-alum, natural waxes, acrylic resins, and the like, which are used for the purpose of decreasing the water absorptivity of the paperboards, work to remarkably reduce air permeability and, for this reason, can not be suitable for sizing paperboards to manufacture gypsum wallboards.

A method has been proposed in the prior art to solve the above-described technical problems encountered in the manufacture of gypsum wallboards, in which the paperboards are treated in advance with certain silicone resins, e.g. an epoxy-modified silicone resin (see, for example, U.S. Pat. Nos. 3,389,042 and 3,431,143). The method, however, is disadvantaged by the following reasons, and can not be satisfactory from the practical point of view.

(1) That certain expensive silicone resins are used in relatively large amounts.

(2) That the paperboards as treated with a silicone resin have to be stored for many days in accumulation before the silicone resin is sufficiently cured and the paperboards are put to processing for the manufacture of gypsum board product.

(3) That the paperboards as finished tend to have non-uniform quality due to local variations in the degree of curing, since the curing reaction of silicones is very susceptible to conditions under which the silicone-treated paperboards are stored.

In addition to the above technical problems which are principally concerned with the bottom liner ply of the multi-ply cover paper directly adjacent the gypsum core, similar problems are encountered with respect of the outermost ply or top liner ply exposed and not in contact with the gypsum core. For example, when a sufficient sizing effect is intended using conventional sizing agents, a great deal of sizing is necessitated and, as a result, not only the air permeability of the resulting paperboard will be lost to an extent inadequate for processing into gypsum wallboards, but also the resistance to moisture absorption, which is also a very desirable property for the finished gypsum wallboard, will not be expected. Therefore, such gypsum wallboards are met with further problems, such as the possibility of the top liner ply to peel during transportation or during secondary processing, e.g. surface finishing, and the intolerable degradation of quality by moisture absorption during storage.

SUMMARY OF THE INVENTION

It is therefore the object of the present invention to provide multi-ply paperboards useful for covering gypsum core wallboards, in which specific sizing free from the above-described technical problems encountered in the prior art is applied.

In accordance with the present invention, the multi-ply paperboard is characterized by being treated or sized at at least one of both surfaces with an organopolysiloxane comprising:

(a) from 99.95 to 85 mole % of organosiloxane units represented by the general formula $$R^1_aSiO_{(4-a)/2} \quad (I)$$

wherein $R^1$ is a hydrogen atom or a monovalent hydrocarbon group selected from the class consisting of methyl, ethyl, propyl, vinyl, and phenyl groups and a is 1, 2, or 3, (b) from 0.05 to 10 mole % of mercapto-containing organosiloxane units represented by the general formula $$HS\text{-}(CH_2)_pSiR^2_bO_{(3-b)/2} \quad (II)$$

where $R^2$ is a hydrogen atom or a monovalent hydrocarbon group selected from the class consisting of methyl, ethyl, propyl, and phenyl groups, b is 0, 1, or 2 and p is 1, 2, 3, or 4, and (c) from 0 to 5 mole % of methacryloxy-containing organosiloxane units represented by the general formula $$H_2C{=}C(CH_3){-}CO{-}O\text{-}(CH_2)_qSiR^3_cO_{(3-c)/2} \quad (III)$$

wherein $R^3$ is a hydrogen atom or a monovalent hydrocarbon group selected from the class consisting of methyl, ethyl, propyl, and phenyl groups, c is 0, 1, or 2 and q is 1, 2, 3, or 4.

DETAILED DESCRIPTION OF THE PREFERRED EMBODIMENTS

The base of a paperboard to be sized with the organopolysiloxane in accordance with the present invention may be of any commercially available grades, which are prepared by blending in a suitable manner several materials, such as pulp, waste high-quality paper, newsprints, magazines, corrugated paperboards, and the like, and then subjecting the mixture to disintegration and beating, followed by a multi-ply paper making process hitherto known in the art, with addition of several known additives including sizing materials and the like. In particular, the paperboards widely used for gypsum wallboards are desirably composed of a plurality of plies, usually from 5 to 8 or even more plies, i.e, the bottom liner ply, the top liner ply, and several filler plies intermediate the bottom and top liner plies.

The organopolysiloxane as the sizing material in accordance with the present invention is composed of the organosiloxane units as represented by the general formulas (I), (II), and (III), the inclusion of the units of formula (III) being optional.

In the organosiloxane unit represented by the general formula (I), the group expressed by the symbol $R^1$ is a hydrogen atom or a monovalent hydrocarbon group selected from the class consisting of methyl, ethyl, propyl, vinyl, and phenyl groups, the most preferred being methyl, and a is a number of 1, 2, or 3. The mole fraction of such organosiloxane units is required to be from 99.95 to 85 mole % of all of the organosiloxane units of which the organopolysiloxane is composed. It is optional to use in combination the organosiloxane units having different values to form the component (a), preferably provided that more than 80 mole % of the component (a) are organosiloxane units having the value of a=2.

In the mercapto-containing organosiloxane units represented by the general formula (II), the group $R^2$ is the same as $R^1$ above excepting the vinyl group, the most preferred being methyl, and b is a number of 0, 1 or 2, the preferred being 0 or 1. The value of p is 1, 2, 3 or 4, the most preferred being 3 from the standpoint of easy preparation of the organopolysiloxane, although the p value has no particular influence on the quality of the product. The mole fraction of the organosiloxane units represented by the general formula (II) is in the range from 0.05 to 10 mole % of all of the organosiloxane units of which the organopolysiloxane is composed. This is because smaller amounts of the mercapto-containing organosiloxane units than 0.05 mole % will result in decreased bonding strength between the paperboards and the gypsum core, while larger amounts than 10 mole % will disadvantageously bring about decreases in the stability of the organopolysiloxane and in production cost.

The methacryloxy-containing organosiloxane units represented by the general formula (III) is optionally present in the organopolysiloxane in a mole fraction in the range up to 5 mole % of all of the organosiloxane units of which the organopolysiloxane is composed. The organosiloxane units of this type contribute to improving the bonding strength between the paperboards and the gypsum core as well as the mechanical strengths of the individual plies of the paperboards. In the formula (III), $R^3$ is the same as $R^2$ above, the most preferred being methyl, and c is preferably 0 or 1. The number of q is 1, 2, 3 or 4, the preferred being 3 for the reason of easiness in the synthetic preparation.

The molecular configuration of the organopolysiloxane may be straight chain, branched chain, cyclic, or three-dimensional network. The molecular chains may be endblocked by hydroxy groups; trialkylsilyl groups, e.g. trimethylsilyl groups; or those groups having alkoxy groups in place of the alkyl groups in the trialkylsilyl groups, e.g. dimethylmethoxysilyl groups.

The synthetic procedures for the mercaptoalkyl-containing organosilanes and the methacryloxyalkyl-containing organosilanes which correspond to the organosiloxane units (b) and (c), respectively, in the organopolysiloxane useful in the present invention are well known in the art of silicones, as disclosed, for example, in U.S. Pat. No. 3,532,729 and West German OLS No. 1,646,152.

These organosilanes are admixed with the organosiloxane composed of the organosiloxane units (a) or organosilanes corresponding to the organosiloxane units (a), and the mixture is subjected to the conventional co-gydrolysis and co-condensation, to form the organopolysiloxane of the present invention. In the preparation of the organopolysiloxanes, it is recommended to apply the known procedure of emulsion polymerization in order to produce an aqueous emulsion which is stable and advantageous for use as the sizing agent for paperboards.

Now, the method of sizing the paperboards using the above-prepared organopolysiloxane in accordance with the present invention will be described in the following.

The organopolysiloxane as the sizing agent may, needless to say, be introduced into a beater in which raw materials for making paper are blended and beated, though this method is not recommended from the standpoint of economy. An advantageous and recommendable method is the so-called surface sizing, by which the bottom surface or top surface or both bottom and top surfaces of a prepared paperboard base are coated with a liquid containing the sizing agents. The coating liquid may be a solution of the organopolysiloxane in an organic solvent but, preferably, an aqueous emulsion of the organopolysiloxane since it is economically advantageous and free from the cause of environmental pollution. The content of the organopolysiloxane in the coating liquid, usually being below a few percent or, for example, in the range from 0.5% to 3% by weight, can be adjusted as desired to obtain an optimum amount of the sizing.

The organopolysiloxane useful in the present invention can cure without the aid of any curing catalyst. However, it is optional that a certain kind of known curing catalysts, such as metal salts of organic acids, is added to the organopolysiloxane-containing coating solution in order to accelerate the curing. It is also optional to add a silane coupling agent for the purpose of improving the bonding strength of the organopolysiloxane to the paperboard texture. It is further optional to add one or more of the conventional sizing agents, such as aluminum sulfate, maleic anhydride-styrene copolymers, and the like. Alternatively, the top surface and/or the bottom surface of the paperboard base may be treated in advance with any one of these conventional sizing agents. The most economical and convenient way for obtaining the accelerated cure of the organopolysiloxane is practiced by adjusting the acidity of the aqueous slurry in the paper making process, since the curing is accelerated in proportion to acidity. The desired acidity is from pH 4.0 to pH 6.5.

The means for applying the coating liquid to the bottom or top surfaces of the paperboard base is not particularly limited, but it may include calender coating, roller coating, and spray coating hitherto known in the art. The thus coated paperboards are dried and stored in the form of roll. The curing of the organopolysiloxane on the paperboard in accordance with the present invention can be completed within one to a few days' storage to give stabilized sizing effect, compared to the case in which the cardboard is sized with a conventional epoxy-modified silicone resin, the stabilization of the sizing effect taking 10 days or even longer.

The optimum sizing amount in the above-described surface sizing of the paperboards in accordance with the present invention is determined depending, for example, on whether the paperboard is intended for use as the front cover or back cover of a gypsum core wallboard. As a general standard in the sizing of the bottom surface, however, the sizing amount is in the range from 15 g to 200 g or, preferably, from 40 g to 160 g of the organopolysiloxane per 1,000 kg of paperboard. An approximately similar range of amounts may be applied to the sizing of the top surface of the paperboard. Any smaller sizing amounts naturally give an insufficient sizing effect, while any larger amounts are considered to be disadvantageous due not only to decreases in water absorptivity and air permeability of the paperboard products but also to increases in cost of production in view of the expensive organopolysiloxane.

The following examples further illustrate the present invention by giving detailed descriptions on the preparation of mercaptoalkyl-containing organopolysiloxanes and the paperboards for gypsum wallboards sized with those organopolysiloxanes as the sizing material.

In the examples, the water absorptivity of the paperboards is expressed by the Cobb values as determined in accordance with Japanese Industrial Standard (JIS) P 8140 "Testing Method for Water Absorptivity of Paper and Paperboard (Cobb Test)", and the air permeability of the paperboards is expressed by the values as determined in accordance with JIS P 8117 "Testing Method for Air Permeability of Paper and Paperboard".

EXAMPLE 1

Into a mixture of 29 g (0.147 mole) of 3-mercaptopropyltrimethoxysilane and 320 g (4.33 moles as dimethylsiloxane units) of octamethylcyclotetrasiloxane under vigorous agitation was dropped 650 g of a 1.5% by weight aqueous solution of sodium laurylsulfate, to form a homogeneous aqueous emulsion.

The aqueous emulsion above obtained was treated with an ion exchange resin Amberlite IR121 (trademark of Rohm & Haas Co.) to convert the sodium laurylsulfate into an acid form, and then the ion exchange resin was removed. The resultant emulsion was further agitated for 70 hours at 25° C., followed by neutralization with an aqueous solution of sodium carbonate to a pH value of 6 to 7, to obtain a stable latex-like emulsion of a copolymerized organopolysiloxane containing mercaptopropyl groups. The aqueous emulsion thus obtained was diluted with water to have a solid content of about 0.7% by weight, which is hereinafter referred to as the coating liquid A.

With this coating liquid A a six-ply paperboard to be used as the front cover for a gypsum wallboard is coated at the bottom surface which had been treated by aluminum sulfate, followed by drying, to effect the surface sizing using the mercaptopropyl-containing organopolysiloxane. The sizing amount obtained was about 134 g or 70 g calculated as the organopolysiloxane per 1,000 kg of paperboard, the sizing amount having been attained by adjusting the amount of the coating liquid applied.

The thus sized paperboards were stored at room temperature and during the storage period, they were tested for water absorptivity at certain intervals of time. According to the test, it took from 30 minutes to 1 hour and from 12 hours to 20 hours for the Cobb Value to reach the upper limit of its range suitable for use in the gypsum wallboard manufacture, i.e. 0.6 g/100 $cm^2$, with the above-mentioned sizing amounts of 134 g and 70 g, respectively. The sized paperboard with the sizing amount of 134 g was further subjected to storage at room temperature to undertake the Cobb Test at 24 hours' intervals, resulting to find that the Cobb value reached about 0.12 g/100 $cm^2$ after 2 days and then became stationary with very little variations thereafter.

For comparison, a similar sizing test was performed under the same conditions except that the sizing material was a conventional epoxy-modified organopolysiloxane (RE-29, product of Nippon Unicar Co., Japan) and the sizing amount was 150 g per 1000 kg of paperboard. The Cobb values of this comparative sized paperboard determined within 30 minutes immediately after treatment ranged from 1.2 to 1.4 g/100 $cm^2$, exhibiting almost no sizing effect. It took from 5 to 10 days of curing when stored at room temperature before the Cobb value as low as 0.6 g/100 $cm^2$ was obtained. This value had a further, gradual lowering tendency toward a final stationary value which appeared after 15 days from the treatment. During the period, there were witnessed local variations in the Cobb value as large as 0.3 to 0.9 g/100 $cm^2$.

EXAMPLE 2

A six-ply paperboard to be used as the back cover for a gypsum wallboard was surface-sized at the bottom surface which had been treated by aluminum sulfate, using the same coating liquid A as in Example 1, the sizing amount being 160 or 92 g. The Cobb value of the thus sized paperboards reached as low as 0.6 g/100 $cm^2$ only after 1 to 6 hours and 10 to 15 hours from the treatment for the sized paperboards with the sizing amounts of 160 g and 92 g, respectively. Stationary values were obtained after about 2 days.

For comparison, a similar sizing test was performed under the same conditions except that the sizing material was the same epoxy-modified organopolysiloxane as used in Example 1. The results showed that the Cobb value reached as low as 0.6 g/100 $cm^2$ after 11 to 19 days for the sized paperboard with the sizing amount of 180 g and the stabilization of the Cobb values was attained only after 1 month from the treatment.

EXAMPLE 3

Measurement of air permeability was undertaken with respect to sized paperboards of the present invention prepared in accordance with the procedure of Example 1 and also with respect to the comparative sample which was sized with the epoxy-modified organopolysiloxane as in Example 1. In this case, however, varied sizing amounts as indicated in Table I were employed, and the results of the air permeability and the Cobb values as determined after 1, 3 and 7 days from the treatment are set out in the table.

As is evident from the data in the table, the epoxy-modified organopolysiloxane necessitated a sizing amount as much as 300 g or more in order to attain practically suitable Cobb values at the sacrifice of air permeability. On the contrary, the Cobb values of the sized paperboards in accordance with the present invention could sufficiently be low even with very small sizing amounts, and this was reflected in turn on the much higher air permeability.

Table I

| | Sizing amount, g | Air permeability, sec. | Cobb value, g/100 $cm^2$ 1 day | 3 days | 7 days |
|---|---|---|---|---|---|
| Present invention | 67 | 40 | <0.6 | <0.3 | — |
| | 133 | 60 | <0.4 | <0.2 | — |
| | 130 | 60 | — | 1–1.3 | 0.6–1.2 |
| | 167 | 120 | — | 1–1.3 | 0.6–1.2 |
| Comparison | | | | | |
| | 233 | 250 | — | 0.7–0.8 | 0.6–0.8 |
| | 333 | 400 | — | 0.2–0.4 | <0.4 |

EXAMPLE 4

A test for the manufacture of gypsum wallboards was undertaken in a commercial plant using the sized and 1-day cured paperboards of the invention prepared in Examples 1 and 2 as the front-covering and back-covering sheets, respectively, for the gypsum wallboard. The test, in which of starch was added in varied amounts to the aqueous slurry of gypsum were employed, was intended to determine the minimum amount of the starch which could be added without decreasing the bonding strength between the gypsum core and the paperboard or causing cleavages between the individual plies of the paperboard. The bonding strength was determined in accordance with the method as specified in JIS A 6901 "Gypsum Boards".

For comparison, a similar test was undertaken with paperboards sized with a conventional rosin-alum or with the paperboards prepared in Examples 1 and 2 with the epoxy-modified organopolysiloxane as the sizing material which had been cured in 3 days and 10 days, respectively.

The results of the above tests are summarized in Table II to show the minimum amounts of starch in terms of g per square meter of the finished gypsum wallboard.

Table II

| Thickness of gypsum wallboard, mm | Sizing material used: Comparison: Rosin-alum | 3-day cured epoxy-modified organopolysiloxane | 10-day cured epoxy-modified organopolysiloxane | Present Invention |
|---|---|---|---|---|
| 12 | 20–40* | 20 | 18–6* | 5 |
| 9 | 10–20* | 13 | 18–6* | 5 |

In the above table, the minimum amounts marked * are not indicated in a single, definite value. This is because the starch was used in an increased amount to somewhat an excessive level to give sufficient safety factors in consideration of the rather unstable water absorptivity to be obtained when the conventional sizing material was employed. On the contrary, the data as for the present invention are indicative of the facts that the amount of starch can be remarkably reduced and that the amount of starch can be constant independently of the thickness of the gypsum wallboard.

The paperboards employed as the front-covering and back-covering sheets for the gypsum wallboard in the above tests were what had been provided with surface sizing only at the bottom surfaces, and not at the top surfaces. A further test was carried out with the paperboards which had been surface-sized at both the top and bottom surfaces in accordance with the present invention, to find that the sizing effect was much stronger compared to that obtained by the conventional sizing materials, without decreases in air permeability and with improved moisture absorption.

A further sizing effect was determined by the surface strength of the sized paperboard and, for comparison, of an unsized paperboard in accordance with JIS P 8129 "Testing Method for Surface Strength of Paper and Paperboard", in which the Denison wax sticks each having a number of from 2A to 20A to show its own adhesivity was one by one fused to the top and bottom liner surface of the paperboard and, after being permitted to cool about 15 minutes, pulled off the surface. In this case the biggest number of the wax stick which could be detached from the surface leaving no harm on the surface was taken as the "surface strength" of the paperboard. The surface strength obtained by this test is shown in Table III.

Table III

| | Unsized paperboard (Comparison) | Sized paperboard (Present invention) |
|---|---|---|
| As the front cover | 6A | 8A-10A |
| As the back cover | 4A | 6A-8A |

The products of gypsum wallboard manufactured with the paperboards of the present invention were found to have lesser problems of cleavage between the plies of the paperboard when subjected to secondary processing, as well as peeling of the surface paper layer during handling or transportation. In addition, the products did not exhibit such quality-wise degradation due to absorption of the atmospheric moisture as had used to occur in the conventional products even after storage for more than 30 days.

EXAMPLE 5

Coating liquids B, C and D were prepared as follows.

Coating liquid B: Into a mixture composed of 15 g (0.0894 mole) of mercaptopropylmethyldimethoxysilane, 157 g (2.12 moles as dimethylsiloxane units) of octamethylcyclotetrasiloxane and 3.5 g (0.0432 mole as trimethylsiloxy units) of hexamethyldisiloxane under agitation was dropped 325 g of a 1.5% by weight aqueous solution of sodium dodecylbenzene sulfonate, to form an aqueous emulsion. This aqueous emulsion was then treated with an ion exchange resin Amberlite IR 121 to convert the sodium dodecylbenzene sulfonate to acid form, followed by removal of the ion exchange resin. The resultant aqueous emulsion was further agitated for 40 hours at 25° C. and neutralized with a 5% aqueous solution of sodium carbonate to a pH value of 6.0, to produce a stable aqueous emulsion of an organopolysiloxane. This emulsion was diluted with water to a solid content of 1.0%.

Coating liquid C: Into a mixture of 39.9 g (0.366 mole) of mercaptopropylmethyldimethoxysilane, 9.6 g (0.076 mole as methylhydrogensiloxane units) of tetramethylcyclotetrasiloxane and 255.5 g (3.45 moles as dimethylsiloxane units) of octamethylcyclotetrasiloxane under agitation was dropped 700 g of a 1.4% aqueous solution of sodium laurylsulfate, to form an aqueous emulsion. This aqueous emulsion was subjected to treatment with an ion exchange resin as in the preparation of the coating liquid B. The resultant aqueous emulsion was further agitated for 40 hours at 25° C. to copolymerize the siloxanes, followed by neutralization with triethanolamine to a pH value of 6.5 to produce a stable aqueous emulsion of the organopolysiloxane, which was then diluted with water to a solid content of 1.0%.

Coating liquid D: Into a mixture composed of 17.6 g (0.078 mole) of mercaptoethylethylphenylmethoxysilane and 288 g (3.89 moles as dimethylsiloxane units) of octamethylcyclotetrasiloxane under agitation was dropped 700 g of a 1.4% aqueous solution of laurylsulfuric acid to form an aqueous emulsion, followed by further agitation for 10 hours at 50° C. to effect polymerization. After cooling the emulsion was neutralized by the addition of a 10% aqueous solution of sodium carbonate to a pH value of 6.5 to produce a stable aqueous emulsion of the organopolysiloxane, which was then diluted with water to a solid content of 1.0%.

The coating liquids B, C and D above prepared were employed for treating paperboards in the same manner as in Example 1. The coating amount was 70 to 90 g per 1,000 kg each. Cobb values were determined for the thus sized paperboards immediately after drying and 1 to 7 days after treatment. The results are set out in Table IV.

Table IV

| Coating liquid | (g/100 cm²) Immediately after drying | Days after treatment 1 | 2 | 4 | 7 |
|---|---|---|---|---|---|
| B | 0.60 | 0.13 | 0.12 | 0.12 | 0.12 |
| C | 0.60 | 0.14 | 0.12 | 0.12 | 0.12 |
| D | 0.60 | 0.15 | 0.13 | 0.13 | 0.12 |

EXAMPLE 6

Coating liquids E and F were prepared as follows.

Coating liquid E: A mixture composed of 134 g (1.0 mole as mercaptopropylmethylsiloxane units) of tetra(mercaptopropyl)tetra-methylcyclotetrasiloxane, 740 g (10.0 moles as dimethylsiloxane units) of octamethylcyclotetrasiloxane, 232 g (0.935 mole) of methacryloxypropyltrimethoxysilane and 16 g (0.197 mole as trimethylsiloxy units) of hexamethyldisiloxane was added with 40 g of activated clay. The resulting mixture was heated with agitation at 60° C. for 8 hours. After cooling to 30° C. or below, 0.5 g of hexamethyldisilazane was added, then the activated clay was removed by filtration, and the low-boiling components were distilled off by heating at 110° C. under a reduced pressure of 10 mmHg, to produce a clear, colorless and oily liquid.

To 300 g of the oily liquid thus obtained were added 695 g of water and 5 g of Newcol 512 (tradename of Japan Emulsifiers Co. Ltd.), an emulsifier expressed by the formula $C_9H_{19}—C_6H_4—(OC_2H_4)_{12}OH$. The mixture was vigorously agitated to form a stable aqueous emulsion, which was then diluted with water to a solid content of 1.0%.

Coating liquid F: A mixture of 25 g (0.186 mole) of mercaptopropylmethyldimethoxysilane, 9 g (0.036 mole) of methacryloxypropylmethyldimethoxysilane, 260 g (3.52 moles as dimethylsiloxane units) of octamethylcyclotetrasiloxane and 16.2 g (0.20 mole as trimethylsiloxy units) of hexamethyldisiloxane was added with 690 g of a 1% aqueous solution of sodium laurylsulfate and emulsified with agitation. The aqueous emulsion thus obtained was treated with an ion exchange resin in the same manner as in Example 5, followed by further agitation for 70 hours at 25° C. and subsequent neutralization by the addition of a 5% aqueous solution of sodium carbonate to a pH value of 6.5, to produce a stable aqueous emulsion of the organopolysiloxane, which was then diluted with water to a solid content of 1.0%.

The coating liquids E and F above prepared were used to size the paperboards in the same manner as in Example 1, the sizing amount being 70 to 90 g/1,000 kg. The Cobb values of the thus sized paperboards were determined immediately after drying and 1 to 7 days after the treatment, with the results as set out in Table V.

Table V

| Coating liquid | (g/100 cm²) Immediately after drying | Days after treatment 1 | 2 | 4 | 7 |
|---|---|---|---|---|---|
| E | 0.60 | 0.12 | 0.12 | 0.12 | 0.12 |
| F | 0.60 | 0.12 | 0.12 | 0.12 | 0.12 |

A gypsum wallboard was manufactured with the paperboards sized with the coating liquids E and F as the front-covering and the back-covering sheets in the same manner as in Example 4, to attain very satisfactory results just the same as in that example.

What is claimed is:

1. A paperboard for a gypsum wallboard which is sized at at least one of both surfaces with an organopolysiloxane comprising (a) from 99.95 to 85 mole % of organosiloxane units represented by the general formula $$R^1_aSiO_{(4-a)/2}$$

where $R^1$ is a hydrogen atom or a monovalent hydrocarbon group selected from the class consisting of methyl, ethyl, propyl, vinyl, and phenyl groups and a is 1, 2, or 3, (b) from 0.05 to 10 mole % of mercapto-containing organosiloxane units represented by the general formula $$HS\text{-}(CH_2)_pSiR^2_bO_{(3-b)/2}$$

where $R^2$ is a hydrogen atom or a monovalent hydrocarbon group selected from the class consisting of methyl, ethyl, propyl, and phenyl groups, b is 0, 1, or 2 and p is 1, 2, 3, or 4, and (c) from 0 to 5 mole % of methacryloxy-containing organosiloxane units represented by the general formula $$H_2C{=}C(CH_3){-}CO{-}O\text{-}(CH_2)_qSiR^3_cO_{(3-c)/2}$$

where $R^3$ is a hydrogen atom or a monovalent hydrocarbon group selected from the class consisting of methyl, ethyl, propyl, and phenyl groups, c is 0, 1, or 2 and q is 1, 2, 3 or 4, and wherein the amount of sizing is in the range from 15 g to 200 g of the organopolysiloxane per 1,000 kg of the paperboard on either one of the surfaces.

2. The paperboard as claimed in claim 1 which is sized at the top surface alone.

3. The paperboard as claimed in claim 1 which is sized at the bottom surface alone.

4. The paperboard as claimed in claim 1 which is sized at both the top and the bottom surfaces.

5. The paperboard as claimed in claim 1 wherein the group $R^1$ is a methyl group.

6. The paperboard as claimed in claim 1 wherein the number a is 2.

7. The paperboard as claimed in claim 1 wherein the group $R^2$ is a methyl group.

8. The paperboard as claimed in claim 1 wherein the number b is 0 or 1.

9. The paperboard as claimed in claim 1 wherein the group $R^3$ is a methyl group.

10. The paperboard as claimed in claim 1 wherein the number c is 0 or 1.

* * * * *